United States Patent [19]

Mackerle

[11] 3,986,435

[45] Oct. 19, 1976

[54] GAS COMPRESSORS AND MOTORS

[75] Inventor: Julius Mackerle, Prague, Czechoslovakia

[73] Assignee: Agrotechnika, narodny podnik, Zvolen, Czechoslovakia

[22] Filed: Mar. 14, 1975

[21] Appl. No.: 558,246

[30] Foreign Application Priority Data

Mar. 15, 1974 Czechoslovakia ..... 1900-74

[52] U.S. Cl. ..... 91/499; 417/269

[51] Int. Cl.[2] ..... F04B 13/04

[58] Field of Search ..... 91/499, 503, 472; 417/269; 74/60

[56] References Cited

UNITED STATES PATENTS

| | | | |
|---|---|---|---|
| 1,978,595 | 10/1934 | Nothstine | 417/269 |
| 2,991,723 | 7/1961 | Zubaty | 417/269 |
| 3,261,216 | 7/1966 | Woolfenden | 74/60 |
| 3,514,221 | 5/1970 | Hasouenoph et al. | 417/271 |

FOREIGN PATENTS OR APPLICATIONS

| | | | |
|---|---|---|---|
| 1,202,109 | 1/1960 | France | 417/270 |
| 644,086 | 8/1962 | Italy | 417/269 |
| 80,021 | 5/1951 | Poland | 417/269 |
| 669,809 | 4/1952 | United Kingdom | 417/477 |

*Primary Examiner*—William L. Freeh

[57] ABSTRACT

A gas compressor or motor of the elastic bellows type is provided with improved facilities for maintaining the diaphragm in contact with an actuating member that reciprocates the roll sock between its expanded and compressed positions. An auxiliary piston-cylinder set is disposed within the machine housing to establish a pressure differential between the two sides of the roll sock as the actuating member retracts so that the difference in air pressure maintains the surface of the roll sock firmly in contact with the actuating means. The resulting prevention of collapse of the roll sock permits a full intake of operating air or other gaseous fluid during the suction stroke, and greatly improves the efficiency of the machine.

5 Claims, 3 Drawing Figures

GAS COMPRESSORS AND MOTORS

BACKGROUND OF THE INVENTION

In certain known types of compression-type gas machines, such as air compressors, an elastic bellows or diaphragm bounding one side of a working chamber is alternately operated by means of a reciprocating piston or other actuating means between an expanded and a compressed position, thereby defining a working cycle of the compressor.

Machines of this type depend for their efficiency on the maintenance of good contact between the actuator and the diaphragm surface. One problem in present designs is that during the suction stroke, residual atmospheric pressure operating on the diaphragm on the external side of the working chamber tends to partially collapse the diaphragm, particularly when its stiffness is low. As a result, the diaphragm tends to move out of contact with the actuator as the latter retracts. The resulting reduction in volume within the working chamber tends to reduce the volume of gas sucked into the working chamber during the suction stroke, so that the efficiency of such arrangements are relatively low.

SUMMRY OF THE INVENTION

These and related problems in the field of compression-type gas machines of the elastic bellows type are solved by means of the arrangement of the present invention.

In an illustrative embodiment, facilities are provided for establishing a pressure differential between the interior and exterior surfaces of the diaphragm (which is conventionally referred to in the art as a "roll sock") and acts as a rolling diaphragm when the roll sock is moved from its compressed to its expanded position. Such pressure differential is in a direction to adhere the external surface of the roll sock to a contact stud of the actuating member as the latter retracts, thereby preventing collapse of the roll sock into the working chamber during the expansion stroke.

Such facilities may include a cylinder affixed to the compressor housing, a piston supported for axial movement within the cylinder, and an element that connects the piston to the actuating member in such a manner that the upward movement of such piston accompanying the retraction movement of the contact stud evacuates air from the portion of the housing in contact with the exterior surface of the roll sock. The actuating member may include a movable sleeve that surrounds an inclined portion of a hollow drive shaft supported for rotation in the compressor housing. As the main portion of the shaft rotates, the inclined portion thereof defines a conical path. Because of the connection between the actuating member and the piston supported in the cylinder, rotation of the movable sleeve is prevented and the conical movement of the inclined portion is translated into the required reciprocation of the contact stud. The interior of the hollow shaft is divided into separate inlet and outlet portions by an inclined septum, and inlet and outlet orifices individually communicating with the inlet and outlet portions on opposite sides of the septum are alternately brought into communication with the interior of the working chamber as the shaft rotates.

BRIEF DESCRIPTION OF THE DRAWING

The invention is further set forth in the following detailed description taken in conjunction with the appended drawing, in which.

DETAILED DESCRIPTION

Figure 1:
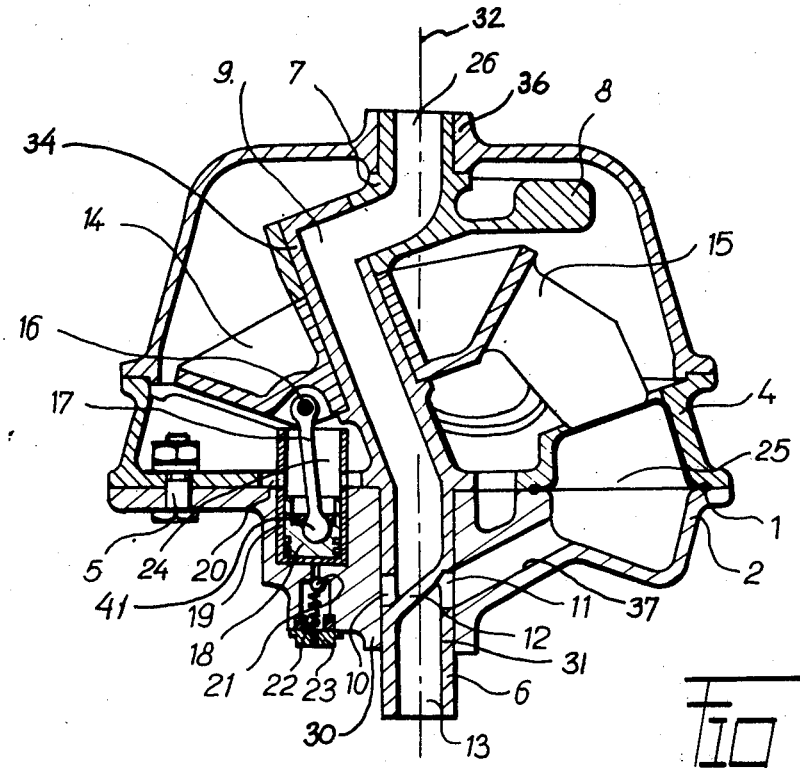
FIG. 1 is a longitudinal view, in section, of a gas compressor constructed in accordance with the invention.

Referring now to the drawing, a compression-type gas machine, illustratively an air compressor, is shown in section in FIG. 1.

The machine includes an overall housing that comprises a main case 1 to which a cover member 2 is removably secured, as by bolts 5.

A hollow drive shaft 6, balanced by a counterweight 8, is supported for rotation within a bearing surface 30 of the cover 2 of the compressor housing, and includes a longitudinal section 31 centered on a main axis 32 of the compressor, and an inclined portion 34 which defines a conical scan around the axis 32 as the longitudinal portion 31 rotates.

The upper end of the inclined portion 34 is in communication with a hollow inlet crank 7, which is supported in a bearing surface 36.

Figure 2:
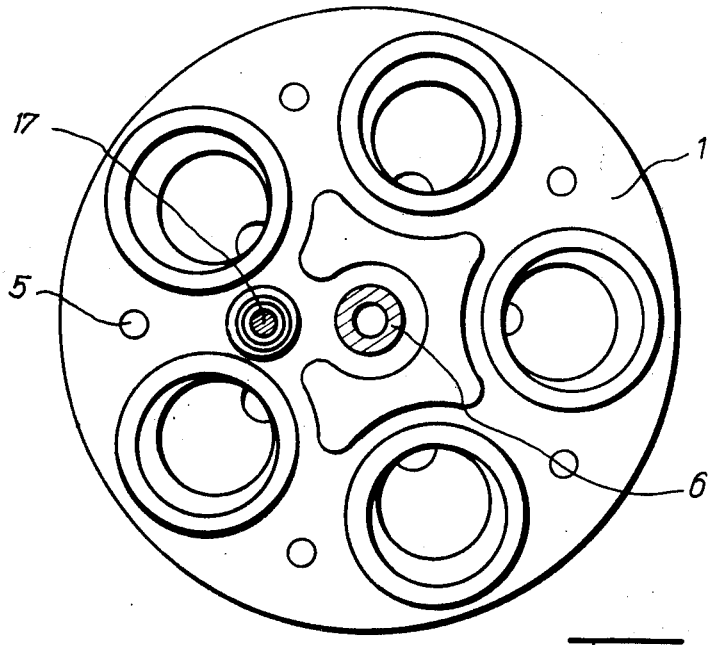
FIG. 2 is an end view of the arrangement of FIG. 1.
Figure 3:
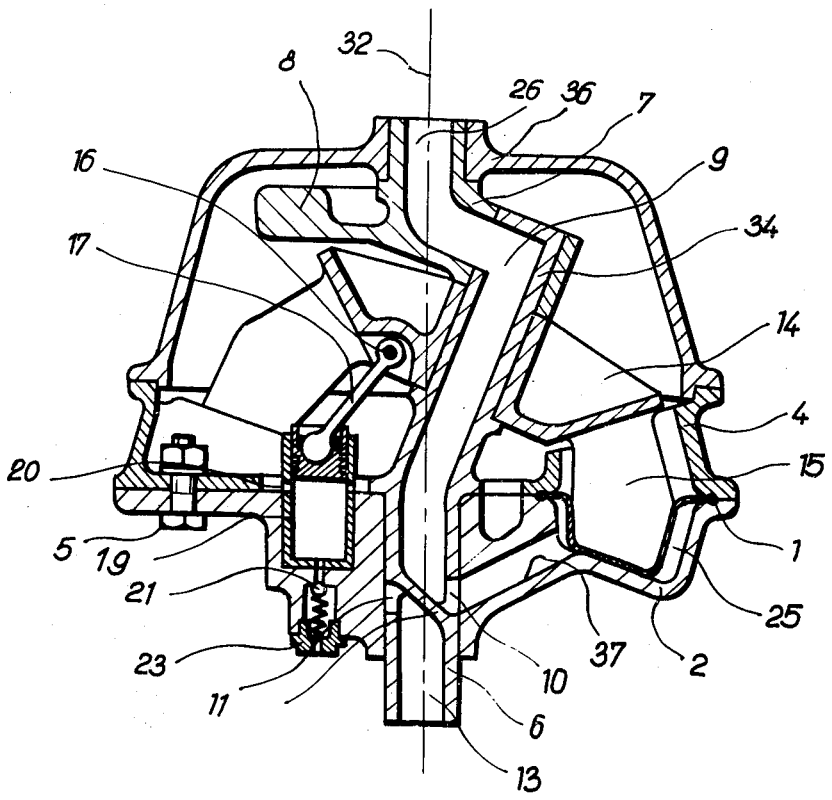
FIG. 3 is a longitudinal view, in section, of the gas compressor of FIG. 1 wherein the drive shaft has shifted 180°from the position illustrated in FIG. 1.

An inclined septum 12 is disposed in the interior of the shaft 6 to divide its hollow interior into an inlet space 9 and a discharge space 13. A radial opening 10 is in communication with the inlet space 9 on one side of the septum 12, and a radial discharge orifice 11 is in communication with the discharge space 13 on the opposite sides of the septum. The openings 10 and 11 are in substantial radial alignment, so that rotation of the shaft 6 alternately presents the openings 10 and 11 opposite one end of a connection channel 37 whose other end opens into a main working chamber 25 of the compressor. A plurality of such chambers (illustratively 5), are symmetrically disposed around the axis 32, as shown best in FIG. 2. Each working chamber 25 is expandable and contractable by means of a roll sock member 4 that is secured at its ends between the case 1 and the cover 2, and which has an exterior surface therof normally in engagement with a contact stud 15 of a reciprocable actuating member 14, whose construction is described below.

The movement of the contact stud 15 against the external surface of the roll sock 4 during the compression stroke of the machine tends to deform the roll sock and reduce the volume of the working chamber 25, and the resultant compression of air therein is routed to the external surroundings via the channel 37 and the discharge space 13 of the shaft 6 when the discharge opening 11 is rotated into alignment with the left end of the channel 37. Similarly, retraction of the contact stud 15 at the conclusion of the compression stroke will ideally cause the roll sock to expand, thereby creating a partial vacuum in the working chamber 25 and admitting inlet air from the interior 26 of the crank 7 and the inlet space 9 of the shaft 6 when the inlet opening 10 is rotated into communication with the left end of the chamber 37.

Ordinarily, during the suction stroke in the chamber 25 (i.e., during the retraction of the contact stud 15 from its lowermost position), atmospheric pressure present inside the case 1 and bearing on the external surface of the roll sock 4 will tend to collapse the roll sock and thereby separate its external surface from the contact stud 15. Consequently, a full expansion of the chamber 25 for the next intake of air will be prevented, and the efficiency of the machine will be lowered. In accordance with the invention, such undesired collapse of the roll sock 4, and its separation at any time from the contact stud 15 is prevented by the facilities now to be described.

In particular, a cylinder 19 is fixedly supported in the compressor housing, and opens upwardly into the interior of the case 1 is shown. A suction opening 20 provides selective communication between the interior of the case 1 and the interior of the cylinder 19.

A piston member 18 is supported for axial movement within the cylinder 19. Such piston is coupled by means of a connecting rod 17 to the actuating member 14, which in the embodiment shown includes a sleeve member movably supported around the inclined portion 34 of the shaft 6. The connecting rod may illustratively be joined to the piston by means of a spherical joint 41, and to the member 14 by means of a connecting bolt 16. With this arrangement, the conical movement of the inclined portion 34 about the axis 32 while the piston 18 coupled to such sleeve member 14 is constrained for longitudinal movement within the cylinder 19 causes the sleeve member 14 to define an undulating movement that is translated into a reciprocation of the contact stud 15, which in turn is affixed to the member 14. In this way, rotation of the shaft 6, which results in the above-mentioned conical scan, effects the generation of the normal suction-compression cycle of the compressor.

In the arrangement shown in FIG. 1, the expansion of the chamber 25 caused by the retraction of the contact stud 15 is accompanied by an upward movement of the piston 18 in the cylinder 19 from its lowermost position shown. Such upward movement of the piston 18 will, in turn, cause a partial vacuum in the cylinder 19, and when the suction openings 20 are exposed upon the attainment by the piston 18 of its uppermost position, air within the case 1, which ordinarily bears on the external surface of the roll sock 4, will be evacuated into the interior space 24 of the cylinder 19 via the now-exposed suction opening 20. The partial vacuum thus formed inside the case 1 will tend to adhere the external or upper surface of the roll sock 4 against the contact stud 15 and prevents collapse of the diaphragm.

As a result, a full expansion of the working chamber 25 is assured during the suction stroke and the efficiency of the machine is greatly improved.

In the foregoing, the invention has been described in connection with an illustrative arrangement thereof. Many variations and modifications will now occur to those skilled in the art. For example, the actuating means 14 may take the form of a piston rod suitably coupled to the drive shaft 6 via a crank to impart the required reciprocatory movement to the external surface of the roll sock 4. Also, by suitable reversal of the air flow the described machine can operate as an improved gas motor instead of a compressor. Additionally, while the operation of a single contact stud 15 associated with a single working chamber 25 has been described in detail, it will be understood that a plurality of similar studs 15 may be affixed to the actuating member to similarly operate the remaining working chambers of the machine. It is accordingly desired that the scope of the appended claims not be limited to the specific disclosure herein contained.

What is claimed is:

1. In a gas compressor or motor, housing means containing at least one working chamber, a hollow shaft rotatably mounted within the housing, the interior of the shaft being in selective communication with the working chamber, an elastic roll sock supported within the housing and bounding one side of the working chamber, the roll sock having interior and exterior surfaces, actuating means coupled to the shaft and normally in contact with the exterior surface of the roll sock for reciprocating the roll sock between an expanded and a compressed position as the shaft rotates, and piston means havin a piston rod mounted in said housing means, the end of said piston rod remote from said piston means being pivotally connected to said actuating means, thereby preventing rotation of said actuating means about said hollow shaft, the other end of said piston rod being connected via a ball and socket joint with said piston means, said piston means establishing a pressure differential between the interior and exterior surfaces of the roll sock when the roll sock moves from its compressed to its expanded positions to maintain the roll sock in contact with the actuating means.

2. A machine as defined in claim 1, in which the shaft has a longitudinal portion and an adjacent inclined portion, the inclined portion defining a conical path as the longitudinal portion rotates, and in which the actuating means comprises a movable sleeve surrounding the inclined portion of the shaft, the movable sleeve having an integral projecting contact stud in contact with the exterior surface of the roll sock.

3. A machine as defined in claim 2, in which the actuating means further comprises cylinder affixed to the housing means, a piston supported for axial movement within the cylinder, and means connecting the piston to the movable sleeve to prevent rotation of the movable sleeve as the shaft rotates.

4. A machine as defined in claim 1, in which the interior of the shaft has separate inlet and outlet portions alternately communicating with the working chamber when the roll sock is in its expanded and compressed positions, respectively.

5. A machine as defined in claim 4, in which the shaft further includes an internal septum separating the inlet and outlet portions, the wall of the shaft being provided with spaced inlet and outlet orifices disposed in communication with the respective inlet and outlet portions on substantially aligned opposite sides of the septum.

* * * * *